US009266161B2

(12) United States Patent
Ma et al.

(10) Patent No.: US 9,266,161 B2
(45) Date of Patent: Feb. 23, 2016

(54) PRODUCTION LINE OF LARGE DIAMETER LONGITUDINAL WELDED PIPE

(75) Inventors: Li Ma, Dalian (CN); Guohong Gao, Dalian (CN); Zhaokui Lang, Dalian (CN)

(73) Assignee: DALIAN SAGE GROUP CO., LTD., Dalian, Liaoning (CN)

( * ) Notice: Subject to any disclaimer, the term of this patent is extended or adjusted under 35 U.S.C. 154(b) by 282 days.

(21) Appl. No.: 13/989,228

(22) PCT Filed: Mar. 23, 2011

(86) PCT No.: PCT/CN2011/072062

§ 371 (c)(1), (2), (4) Date: May 23, 2013

(87) PCT Pub. No.: WO2012/071836

PCT Pub. Date: Jun. 7, 2012

(65) Prior Publication Data

US 2013/0239642 A1 Sep. 19, 2013

(30) Foreign Application Priority Data

Nov. 30, 2010 (CN) ..... 2010 1 0571178
Nov. 30, 2010 (CN) ..... 2010 2 0633883

(51) Int. Cl.
*B21C 37/08* (2006.01)
*B21D 21/00* (2006.01)

(52) U.S. Cl.
CPC ..... *B21D 21/00* (2013.01); *B21C 37/08* (2013.01)

(58) Field of Classification Search
CPC B21C 37/08; B21C 37/0807; B21C 37/0815; B21C 37/0826; B21C 37/083; B21D 21/00
See application file for complete search history.

(56) References Cited

FOREIGN PATENT DOCUMENTS

CN 101474644 A * 7/2009

* cited by examiner

*Primary Examiner* — Debra Sullivan
(74) *Attorney, Agent, or Firm* — Novick, Kim & Lee, PLLC; Allen Xue

(57) ABSTRACT

A production line of large diameter longitudinal welded pipe comprises a material storage table (1), a charging trolley (2), an uncoiler (3), a leveler (4), a shearing and butt welding machine (5), a movable sleeve (6), an edge milling machine (7), a steel plate flaw detector (8), a lifting table (9), a steel pipe forming machine (10), a welding device (11), a pulling device (12), a heat treatment device (13), a cooling device (14), a rigid rolling machine (15), a cut-to-length cutting machine (16) and a discharging rack (17). The production line in the present invention has the advantages including high production efficiency, stable product quality, low manufacturing cost, as well as reliable and convenient operation.

12 Claims, 2 Drawing Sheets

PRODUCTION LINE OF LARGE DIAMETER LONGITUDINAL WELDED PIPE

TECHNICAL FIELD

The present invention relates to production equipment for producing large diameter longitudinal welded pipe, particularly relates to a production line of large diameter longitudinal welded pipe for producing a welded steel pipe with a diameter of bigger than Φ630 mm.

BACKGROUND ART

At present, all industries have more requirements to conveying pipe products in machinery industry with the development of science and technology. For example, a large amount of big-diameter and high-performance conveying pipes, especially conveying pipes with a diameter of bigger than Φ630 mm are required in oil exploration. However, the steel pipe manufacturers both at home and aboard can only produce conveying pipes with a diameter of less than Φ630 mm, and a single method to produce the conveying pipes with a diameter of less than Φ630 mm has always been used. For example, some foreign manufacturers use FFX forming method, namely the flexible forming method, and some other steel pipe manufacturers both at home and aboard normally use a cage roll type forming machine set. Therefore, it has become a difficult problem for the steel pipe manufacturers both at home and aboard to produce the conveying pipes with a diameter of bigger than Φ630 mm using each of the aforementioned single production methods. In a case where the cage roll forming machine is used to produce the large diameter longitudinal welded pipe, forming rolls are to be distributed on a forming surface of a work piece. Even though the forming effect is good, one of outer rolls has to be heavier than 10 tons which makes it difficult to produce and install such big equipment and leads to high investment, low production efficiency and instable welding quality. In particular, the steel pipe manufacturers both at home and aboard cannot use each of the aforementioned single methods to produce a welded pipe with a diameter of bigger than Φ630 mm, therefore, it is still far from building a production line of welded pipe with a diameter of bigger than Φ630 mm. In order to solve the above problem, it is very necessary to develop a production line of large diameter longitudinal welded pipe by which a welded steel pipe with a diameter of bigger than Φ630 mm can be produced.

SUMMARY OF THE INVENTION

In order to avoid the disadvantages and deficiencies in the above technique, the present invention provides a production line of large diameter longitudinal welded pipe which is characterized with reasonable working procedure arrangement, advanced processing machines in each wording procedure, capability of continuously producing large diameter longitudinal welded pipes without using extra heavy equipments, reliable operation, high production efficiency, stable product quality, low manufacturing cost, safe operation and convenient use.

The present invention is realized by the following technical solutions:

a production line of large diameter longitudinal welded pipe, which is disposed according to a technological process of producing a large diameter longitudinal welded pipe, wherein the production line of large diameter longitudinal welded pipe mainly comprises a material storage table, a charging trolley, an uncoiler, a leveler, a shearing and butt welding machine, a movable sleeve, an edge milling machine, a steel plate flaw detector, a lifting table, a steel pipe forming machine, a welding device, a pulling device, a heat treatment device, a cooling device, a sizing and plate type rigid rolling machine, a cut-to-length cutting machine and a discharging rack; a plurality of work pieces in strip coil shape stored on the material storage table are delivered by the charging trolley to the uncoiler; the work pieces, which have been uncoiled by the uncoiler into strip shape, are delivered into the leveler by a pinch mechanism of the leveler for leveling; the front and rear leveled work pieces in strip shape are welded by the shearing and butt welding machine into an integrated slab-shaped work piece for continuous production; subsequently, the slab-shaped work piece is wound on the movable sleeve through a pinch mechanism of the movable sleeve and is delivered into the edge milling machine through an outlet of the movable sleeve, the edge milling machine carries out edge milling and welding groove milling according to a circumference of the work piece, namely a required slab width, and the steel plate flaw detector detects the existence of any flaws; the qualified slab-shaped work piece after the flaw detecting by the steel plate flaw detector is delivered to the steel pipe forming machine through the lifting table, then a steel pipe shaped work piece, which is formed by the steel pipe forming machine, is delivered to the welding device for longitudinal welding, ironing and weld flaw detecting; the steel pipe shaped work piece is driven to move forward by the pulling device which is disposed in a machine set after the welding device in the production line, and a qualified welded-pipe shaped work piece after the weld flaw detecting is sequentially delivered into the heat treatment device and the cooling device; the cooled welded-pipe shaped work piece is delivered into the sizing and plate type rigid rolling machine for sizing in accordance with product standards and requirements, and a qualified work piece in finished product shape after the sizing is delivered into the cut-to-length cutting machine to be cut according to a length required by a user; and is further delivered to the discharging rack for storage and future use.

The lifting table is a height adjustable lifting table driven by a screw lifter.

The steel pipe forming machine sequentially includes an edge hollow-bending device, a cage roll forming machine and a plate type rigid rolling machine; wherein the plate type rigid rolling machine includes a frame body, an upper horizontal roll mechanism, an upper horizontal roll adjusting mechanism, a sliding seat, a supporting plate, a hydraulic cylinder, a lower horizontal roll mechanism, a lower horizontal roll adjusting mechanism, a side vertical roll mechanism and a side vertical roll adjusting mechanism.

The welding device sequentially includes a welding machine, an ironing machine and a weld flaw detector.

The cooling device sequentially includes an air cooling roll table and a water cooling roll table.

The present invention is a coordinated process type continuous production line starting from a raw material process to a process of delivering a finished large diameter welded pipe which meets the user's requirements to the discharging rack according to the technological process of producing a longitudinal welded pipe. In fact, the continuous production line sequentially includes front and rear work pieces in strip shape, a slab-shaped work piece, a finished slab-shaped work piece, a steel pipe shaped work piece, a welded-pipe shaped work piece and a finished product shaped work piece according to different working process of the work pieces. In order to realize the coordinated process type continuous production line, firstly, the leveled front and rear work pieces in strip shape are continuously welded together by the shearing and butt welding machine into an integrated slab-shaped work piece for continuous production, so as to guarantee the first condition of the continuous production line by the raw materials supply process. Besides, in the steel pipe forming process, the steel pipe forming machine including an edge hollow-bending device, a cage roll forming machine and a plate type rigid rolling machine is adopted, because the normal steel pipe forming process includes gradually forming an I-shaped cross section of a work piece into a U-shaped cross section by a forming machine, and finally forming the open U-shaped cross section into a closed O-shaped cross section. Therefore, by analyzing the characteristics of steel pipe forming process, the present invention provides a forming process by the longitudinal welded pipe forming machine set sequentially including an edge hollow-bending device, a cage roll forming machine and a plate type rigid rolling machine. Due thereto, the forming machines in accordance with the steel pipe forming characteristics have been reasonably used in different forming stages. During the stage of forming the I-shaped cross section of the work piece into the U-shaped cross section, the edge hollow-bending device including a plurality of edge bending mechanisms is adopted; during the U-shaped cross section forming stage, the open cage roll forming machine combined by an outer roll device and an inner roll, which includes the outer roll device, the inner roll, a pressing roll device, a lower driving roll, a cross beam, a supporting frame, a base and a lower support roll, is adopted; and during the closed O-shaped cross section forming stage, the plate type rigid rolling machine including three or more plate type rigid frames is adopted, wherein each of the plate type rigid frame includes a frame body, an upper horizontal roll mechanism, an upper horizontal roll adjusting mechanism, a sliding seat, a supporting plate, a hydraulic cylinder, a lower horizontal roll mechanism, a lower horizontal roll adjusting mechanism, a side vertical roll mechanism and a side vertical roll adjusting mechanism. Accordingly, a good forming effect with respect to the welded pipe during the forming process is realized, thereby meeting the market requirement to the production of a welded steel pipe with a diameter of bigger than Φ630 mm. Therefore, the present invention is named as "A production line of large diameter longitudinal welded pipe". In order to guarantee the operation of the present invention to be stable and reliable, a pulling device for driving the steel pipe shaped work piece to move forward is disposed after the welding device process in the production line machine set.

Compared with the prior art, the present invention has not only reasonable working process and advanced processing machines in each procedures, but also capability of continuously producing large diameter longitudinal welded pipe without using extra heavy equipments. The present invention still has advantages of reliable operation, high production efficiency, stable product quality, low manufacturing cost, safe operation and convenient use.

Figure 1:
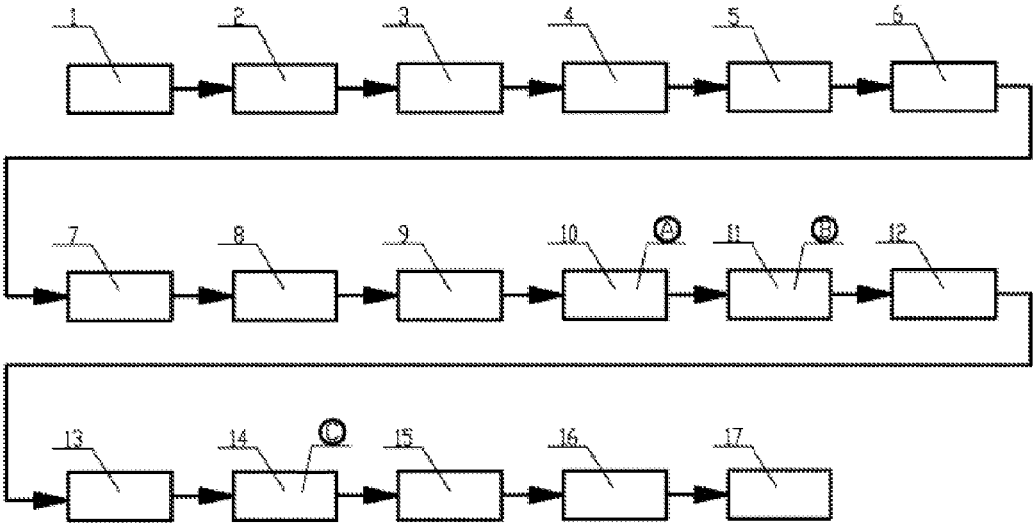
FIG. 1 is a plane layout schematic diagram of processing machines in each process in the embodiments of the present invention.

1. Material storage table; 2. Charging trolley; 3. Uncoiler; 4. Leveler; 5. Shearing and butt welding machine; 6. Movable sleeve; 7. Edge milling machine; 8. Steel plate flaw detector; 9. Lifting table; 10. Steel pipe forming machine; 11. Welding device; 12. Pulling device; 13. Heat treatment device; 14. Cooling device; 15. Sizing and plate type rigid rolling machine; 16. Cut-to-length cutting machine; 17. Discharging rack; 18. Edge hollow-bending device; 19. Cage roll forming machine; 20. Plate type rigid rolling machine; 21. Welding machine; 22. Ironing machine; 23. Weld flaw detector; 24. Air cooling roll table; 25. Water cooling roll table.

DETAILED DESCRIPTION OF THE PREFERRED EMBODIMENTS

FIGS. 1-4 show embodiments of the present invention which is a production line of longitudinal welded pipe with a large diameter of Φ711 mm and is disposed according to a technological process of producing a large diameter longitudinal welded pipe, wherein the production line of large diameter longitudinal welded pipe mainly comprises a material storage table 1, a charging trolley 2, an uncoiler 3, a leveler 4, a shearing and butt welding machine 5, a movable sleeve 6, an edge milling machine 7, a steel plate flaw detector 8, a lifting table 9, a steel pipe forming machine 10, a welding device 11, a pulling device 12, a heat treatment device 13, a cooling device 14, a sizing and plate type rigid rolling machine 15, a cut-to-length cutting machine 16 and a discharging table 17; a plurality of work pieces in strip coil shape stored on the material storage table 1 are delivered by the charging trolley 2 to the uncoiler 3; the work pieces, which have been uncoiled by the uncoiler 3 into strip shape, are delivered into the leveler 4 by a pinch mechanism of the leveler 4 for leveling; the front and rear leveled work pieces in strip shape are welded by the shearing and butt welding machine 5 into an integrated slab-shaped work piece for continuous production; subsequently, the slab-shaped work piece is wound on the movable sleeve 6 through a pinch mechanism of the movable sleeve 6 and is delivered into the edge milling machine 7 through an outlet of the movable sleeve 6, the edge milling machine 7 carries out the edge milling and welding groove milling according to a circumference of the work piece, namely a required slab width, and the steel plate flaw detector detects the existence of any flaws; a qualified slab-shaped work piece after the flaw detecting by the steel plate flaw detector 8 is delivered to the steel pipe forming machine through the lifting table 9, then a steel pipe shaped work piece, which is formed by the steel pipe forming machine 10, is delivered to the welding device 11 for longitudinal welding, ironing and weld flaw detecting; the steel pipe shaped work piece is driven to move forward by the pulling device 12 which is disposed in a machine set after the welding device 11 in the production line, and a qualified welded-pipe shaped work piece after the weld flaw detecting is sequentially delivered into the heat treatment device 13 and the cooling device 14; the cooled welded-pipe shaped work piece is delivered into the sizing and plate type rigid rolling machine 15 for sizing in accordance with product standards and requirements, and a qualified work piece in finished product shape after the sizing is delivered into the cut-to-length cutting machine 16 to be cut according to a length required by a user; and is further delivered to the discharging rack 17 for storage and future use.

The lifting table 9 is a height adjustable lifting table driven by a screw lifter.

Figure 2:
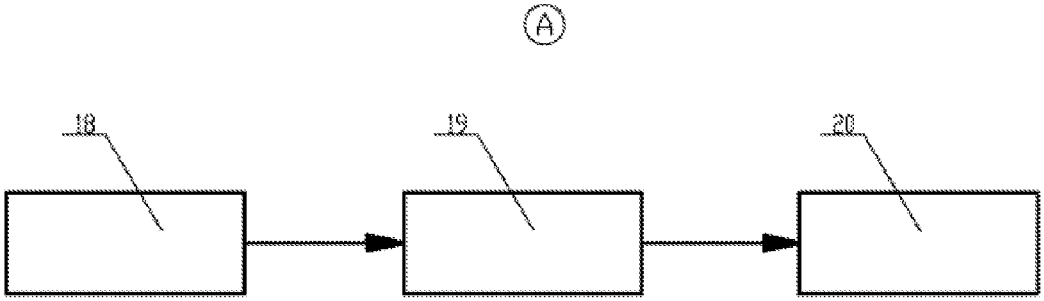
FIG. 2 is an enlarged schematic diagram of part A in FIG. 1.

The steel pipe forming machine 10, as shown in FIG. 2, sequentially includes an edge hollow-bending device 18, a cage roll forming machine 19 and a plate type rigid rolling machine 20; wherein the edge hollow-bending device 18 includes a plurality of edge bending mechanism, the open cage roll forming machine combined by an outer roll device and an inner roll includes the outer roll device, the inner roll, a pressing roll device, a lower driving roll, a cross beam, a supporting frame, a base and a lower support roll; the plate type rigid rolling machine includes a frame body, an upper horizontal roll mechanism, an upper horizontal roll adjusting mechanism, a sliding seat, a supporting plate, a hydraulic cylinder, a lower horizontal roll mechanism, a lower horizontal roll adjusting mechanism, a side vertical roll mechanism and a side vertical roll adjusting mechanism, the plate type rigid rolling machine includes three or more plate type rigid frames, wherein each of the plate type rigid frame includes a frame body, an upper horizontal roll mechanism, an upper horizontal roll adjusting mechanism, a sliding seat, a supporting plate, a hydraulic cylinder, a lower horizontal roll mechanism, a lower horizontal roll adjusting mechanism, a side vertical roll mechanism and a side vertical roll adjusting mechanism.

Figure 3:
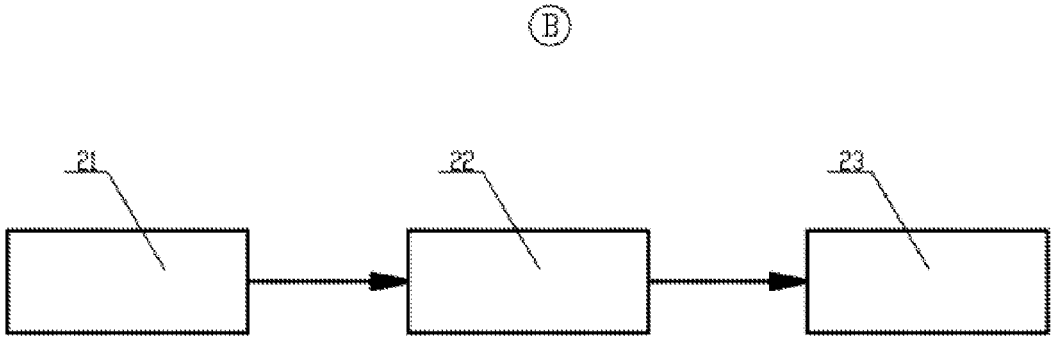
FIG. 3 is an enlarged schematic diagram of part B in FIG. 1.

The welding device, as shown in FIG. 3, sequentially includes a welding machine 21, an ironing machine 22 and a weld flaw detector 23.

Figure 4:
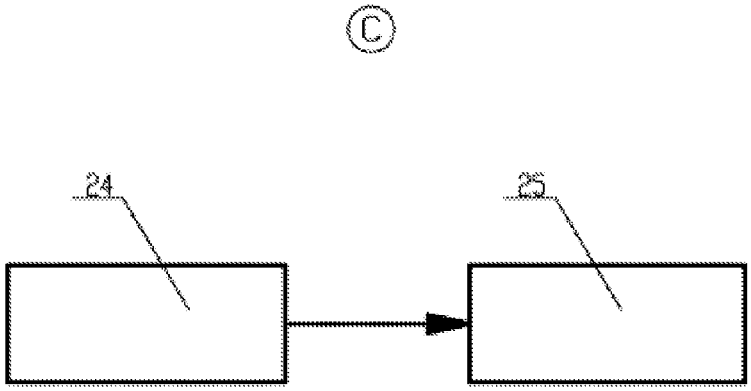
FIG. 4 is an enlarged schematic diagram of part C in FIG. 1.

The cooling device, as shown in FIG. 4, sequentially includes an air cooling roll table 24 and a water cooling roll table 25.

The above descriptions are only preferred embodiments of the present invention, and the protecting scope of the present invention is not limited to it. All equivalent replacements or changes made on the basis of the technical solutions and conceptions of the present invention by practitioners skilled in the art will be included in the protecting scope of the present invention.

We claim:

1. A production line of large diameter longitudinal welded pipe, comprising: a material storage table (1), a charging trolley (2), an uncoiler (3), a leveler (4), a shearing and butt welding machine (5), a movable sleeve (6), an edge milling machine (7), a steel plate flaw detector (8), a lifting table (9), a steel pipe forming machine (10), a welding device (11), a pulling device (12), a heat treatment device (13), a cooling device (14), a sizing and plate type rigid rolling machine (15), a cut-to-length cutting machine (16) and a discharging rack (17), wherein a plurality of work pieces in strip coil shape stored on the material storage table (1) are delivered by the charging trolley (2) to the uncoiler (3); the work pieces, after being uncoiled by the uncoiler (3) into strip shape, are delivered into the leveler (4) for leveling into front and rear leveled work pieces in strip shape, which subsequently are welded by the shearing and butt welding machine (5) into an integrated slab-shaped work piece for continuous production; subsequently, the slab-shaped work piece is wound on the movable sleeve (6) through a pinch mechanism of the movable sleeve (6) and is delivered into the edge milling machine (7) through an outlet of the movable sleeve (6); the edge milling machine (7) carries out edge milling and welding groove milling according to a width of the slab-shaped work piece, and the steel plate flaw detector (8) detects the existence of any flaws; the qualified slab-shaped work piece after the flaw detecting by the steel plate flaw detector (8) is delivered to the steel pipe forming machine (10) through the lifting table (9) to be formed into a steel pipe shaped work piece, the steel pipe shaped work piece is delivered to the welding device (11) for longitudinal welding, ironing and weld flaw detecting; the steel pipe shaped work piece is driven to move forward by the pulling device (12), and a qualified welded-pipe shaped work piece after the weld flaw detecting is sequentially delivered into the heat treatment device (13) and the cooling device (14); the cooled welded-pipe shaped work piece is delivered into the sizing and plate type rigid rolling machine (15) for sizing in accordance with product standards and requirements, and a qualified work piece in finished product shape after the sizing is delivered into the cut-to-length cutting machine (16) to be cut according to a length required by a user, and is further delivered to the discharging rack (17) for storage.

2. The production line of large diameter longitudinal welded pipe according to claim 1, wherein the lifting table (9) is a height adjustable lifting table driven by a screw lifter.

3. The production line of large diameter longitudinal welded pipe according to claim 1, wherein the steel pipe forming machine (10) sequentially includes an edge hollow-bending device (18), a cage roll forming machine (19) and a plate type rigid rolling machine (20).

4. The production line of large diameter longitudinal welded pipe according to claim 1, wherein the welding device (11) sequentially includes a welding machine (21), an ironing machine (22) and a weld flaw detector (23).

5. The production line of large diameter longitudinal welded pipe according to claim 1, wherein the pulling device (12) includes a motor and a reducing transmission mechanism.

6. The production line of large diameter longitudinal welded pipe according to claim 1, wherein the cooling device (14) sequentially includes an air cooling roll table (24) and a water cooling roll table (25).

7. A method for producing large diameter longitudinal welded pipe, comprising sequentially the steps of:

delivering a plurality of steel work pieces in strip coil shape stored on a material storage table (1) using a charging trolley (2) to a uncoiler (3);

uncoiling the plurality of work pieces into steel strips;

leveling the steel strips in a leveler (4) into front and rear leveled work pieces in strip shape, welding the front and rear leveled work pieces in strip shape using a shearing and butt welding machine (5) into an integrated slab-shaped work piece for continuous production;

winding the integrated slab-shaped work piece on a movable sleeve (6) through a pinch mechanism of the movable sleeve (6);

edge milling and welding groove milling the integrated slab-shaped work piece;

conducting flaw detection of the integrated slab-shaped work piece using a steel plate flaw detector (8);

delivering the integrated slab-shaped work piece to a steel pipe forming machine (10) through a lifting table (9) to be formed into a steel pipe shaped work piece;

delivering the steel pipe shaped work piece to the welding device (11) for longitudinal welding, ironing and weld flaw detecting;

pulling the steel pipe shaped work piece using a pulling device (12);

heat-treating a qualified welded-pipe shaped work piece in a heat treatment device (13);

cooling the qualified welded-pipe shaped work piece in a the cooling device (14);

sizing the cooled welded-pipe shaped work piece in a sizing and plate type rigid rolling machine (15);

cutting the qualified work piece in finished product shape after the sizing in a cutting machine (16); and storing is a qualified work piece in finished product shape further in a discharging rack (17).

8. The method of claim 7, wherein the lifting table (9) is a height adjustable lifting table driven by a screw lifter.

9. The method of claim 7, wherein the steel pipe forming machine (10) sequentially includes an edge hollow-bending device (18), a cage roll forming machine (19) and a plate type rigid rolling machine (20).

10. The method of claim 7, wherein the welding device (11) sequentially includes a welding machine (21), an ironing machine (22) and a weld flaw detector (23).

11. The method of claim 7, wherein the pulling device (12) includes a motor and a reducing transmission mechanism.

12. The method of claim 7, wherein the cooling device (14) sequentially includes an air cooling roll table (24) and a water cooling roll table (25).

* * * * *